United States Patent [19]

Scheidecker

[11] 4,143,683

[45] Mar. 13, 1979

[54] DEVICE FOR CONTROLLING AND CUTTING THE WEFT THREADS IN LOOMS WITH WEFT INSERTERS

[75] Inventor: Georges Scheidecker, Mulhouse, France

[73] Assignee: Societe Alsacienne de Constructions Mechaniques de Mulhouse, Mulhouse Cedex, France

[21] Appl. No.: 714,835

[22] Filed: Aug. 16, 1976

[30] Foreign Application Priority Data

Oct. 3, 1975 [FR] France ..... 75 30301

[51] Int. Cl.[2] ..... D03D 47/18

[52] U.S. Cl. ..... 139/450; 139/453

[58] Field of Search ..... 139/429, 430, 437, 438, 139/439, 443, 444, 446, 450, 453

[56] References Cited

U.S. PATENT DOCUMENTS

| | | | |
|---|---|---|---|
| 3,157,208 | 11/1964 | Juillard | 139/450 |
| 3,439,715 | 4/1969 | Juillard | 139/453 |
| 3,613,741 | 10/1971 | Ravella | 139/430 |
| 3,638,686 | 2/1972 | Sole et al. | 139/446 |
| 3,851,677 | 12/1974 | Rossborg | 139/450 |

*Primary Examiner*—Henry S. Jaudon
*Attorney, Agent, or Firm*—Cantor and Singer

[57] ABSTRACT

The present invention relates to means for controlling and for cutting the weft threads in looms with weft inserters. The combination of the means for controlling and for cutting the weft threads comprises a thread cutter carried by the loom framing, as well as a threader and a lowering hook carried by the sley. The thread cutter is constituted by a vertically-movable knife which co-operates with a component provided towards the rear with a weft thread retaining hook. The knife has, towards the rear, an extension for guiding the weft thread into the shed. The threader is formed by a horizontal ramp ended at its rear by an upwardly and forwardly open loop, located above the path of the entry needle, while the lowering hook may adopt, selectively, a high position above the weft thread portion connecting the threader loop to the cloth and a low position in which it presses down and holds one point of said weft thread portion below the path of the nippers of the entry needle. The invention is applicable to loom with weft insertion needles, especially for the manufacture of cloths which comprise effect or fancy threads.

4 Claims, 11 Drawing Figures

DEVICE FOR CONTROLLING AND CUTTING THE WEFT THREADS IN LOOMS WITH WEFT INSERTERS

The invention relates to looms in which the weft threads are inserted into the shed by needles from pirns disposed in fixed locations on the side of the looms, such for example as that described and shown in the commonly assigned U.S. Pat. No. 3,159,186.

It relates more especially to means for controlling and cutting the weft threads when the latter are fancy threads such for example as loop threads, irregular threads which have slubs, or are formed of several threads twisted together. Such threads are difficult to control especially when they are drawn off by the weft-drawing needle out of the entry weft-inserting needle at mid-width of the shed. Indeed in the loom described in the aforesaid U.S. Patent nippers of the entry needle grip the weft thread near its end held in a thread cutter in which it slips, deteriorating as it does, and this is all the more true the less uniform is the fancy thread. This same end of the thread deteriorates a second time at the instant of the exchange when, as it is drawn off by the drawing needle, it slips in the nippers of the entry needle and a third time when the drawing needle straightens its end outside of the shed when the insertion is completed. These successive deteriorations are obviously harmful and risk jeopardizing the proper working of the loom.

In order to remedy this, it would be desirable that the part in question of the weft thread makes up, between the neighbourhood of the selvedge where it is held and the point of its length where it is gripped by the nippers of the needles, a dead end of appreciable length, in order that the deteriorations to which it is liable to be subjected leave in the thread a sound part for the gripping by the nippers of the needles. However, this result is difficult to obtain when the thread cutter, as in the manner in which it is used in the aforesaid patent, is carried by the sley on which the needles travel, more especially as it is also desirable that the weft thread waste, that is to say the part included between the selvedge of the cloth and the point where it is cut, should be of minimum length in order to ensure the minimum loss.

The object of the invention is to provide a combination of means for controlling and cutting the weft threads which does not have the disadvantages of the prior device hereinbefore referred to.

According to the invention the cutting device is located on the stationary loom framing, thus enabling the realisation of a minimum waste, and there is provided, on the sley, means capable of forming a dead end of weft thread of appreciable length and of positioning same, with certainty, in the path of the nippers of the entry needle.

To this end, the aforesaid combination of means comprises a thread cutter carried by the loom framing in the immediate proximity of a selvedge of the cloth as well as a threader and a lowering hook carried by the sley, the thread cutter being constituted by a knife which carries a vertically movable blade co-operating with a stationary counter-blade carried by a member rigidly secured to the loom framing and provided with a weft thread retaining hook at the rear thereof, while the threader is formed by a longitudinal ramp terminating at the rear thereof in an upwardly and forwardly opening eye, located just above the path of the entry needle, and the lowering hook is pivotally mounted on a horizontal axis so as to be able to take up selectively, under the influence of an appropriate control, either a high position above the weft thread portion connecting the threader eye with the cloth when the sley reaches its forward neutral position, or a low position in which it brings down and holds in position a loop of said weft thread portion below the path of the entry needle nippers while the sley already begins to move back by a small amount.

Thanks to this combination of means, the front end of each weft thread inserted into the shed has an extension forming a dead end of appreciable length, which may be made adjustable, and which may be gripped reliably. Moreover, each weft thread is cut quite near the selvedge at infeed, i.e. with the minimum of loss.

The invention will be better understood on reading the description about to follow and examining the accompanying drawings which show, by way of example, means according to the invention for controlling and cutting weft threads in looms with weft inserters.

Figure 1:
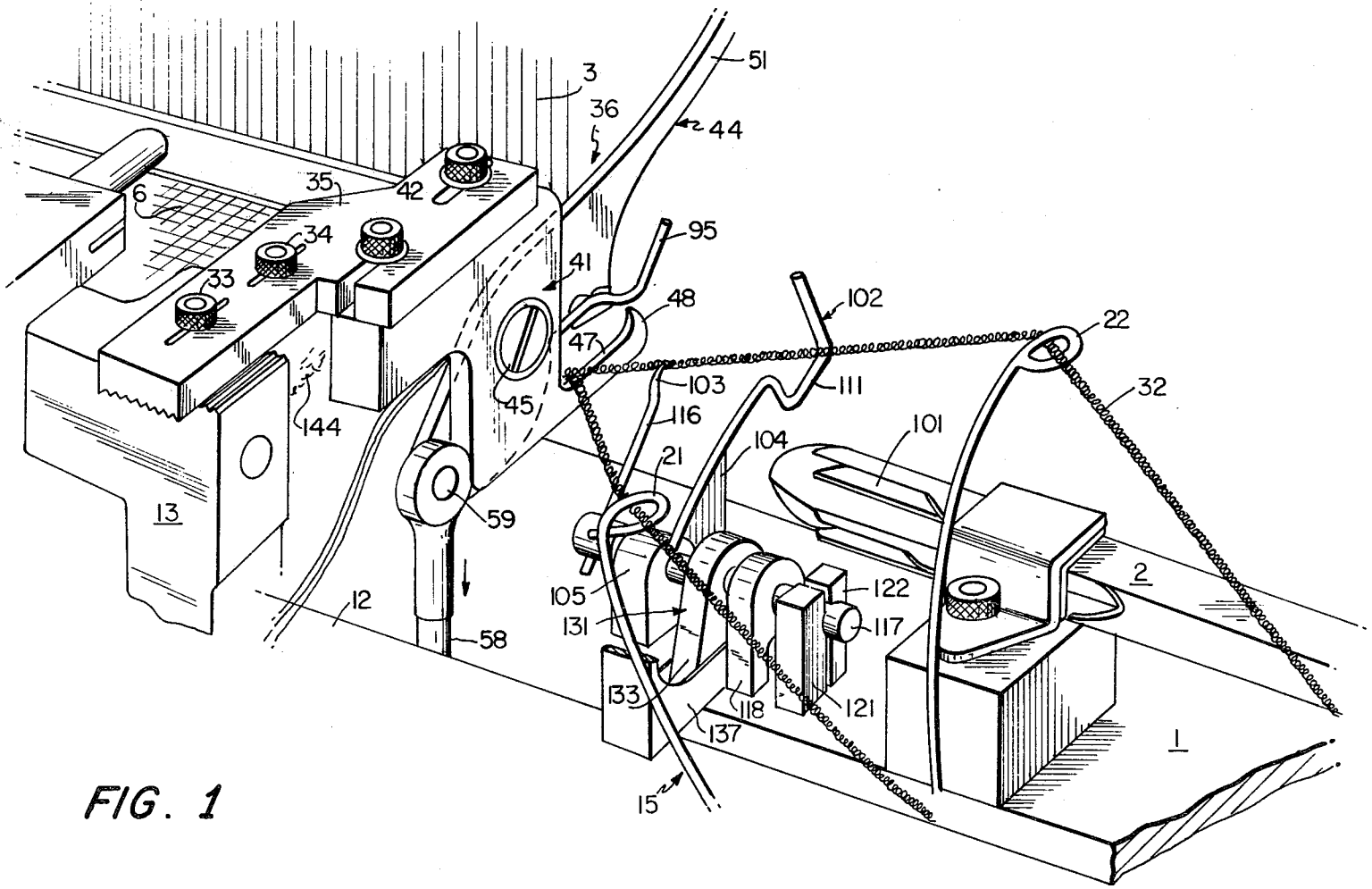
FIG. 1 shows the principal components affected by the invention of a part of the right-hand side of a loom, in particular the corresponding end of the sley, a weft selector, and components for controlling and cutting the weft thread.

If reference is made first of all to FIG. 1, there is seen a part of a loom with weft insertors, of the kind described, for example, in the aforementioned U.S. Pat. No. 3,159,186, to which reference may be made should the occasion arise in order to complement the description.

On the sley 1 of this loom, there travel counter to one another two weft inserters made up of an introducing needle 2 (the only one which can be seen in the drawings) which inserts one end of the weft thread up to halfway into the shed where it is taken over by the pulling or drawing needle which carries it across the second half of the shed. The reed carried by the sley is indicated at 3, the upper sheet of warp threads at 4 (FIG. 11) and the lower sheet of warp threads at 5, while the formed fabric is indicated at 6 (FIG. 1).

Figure 9:
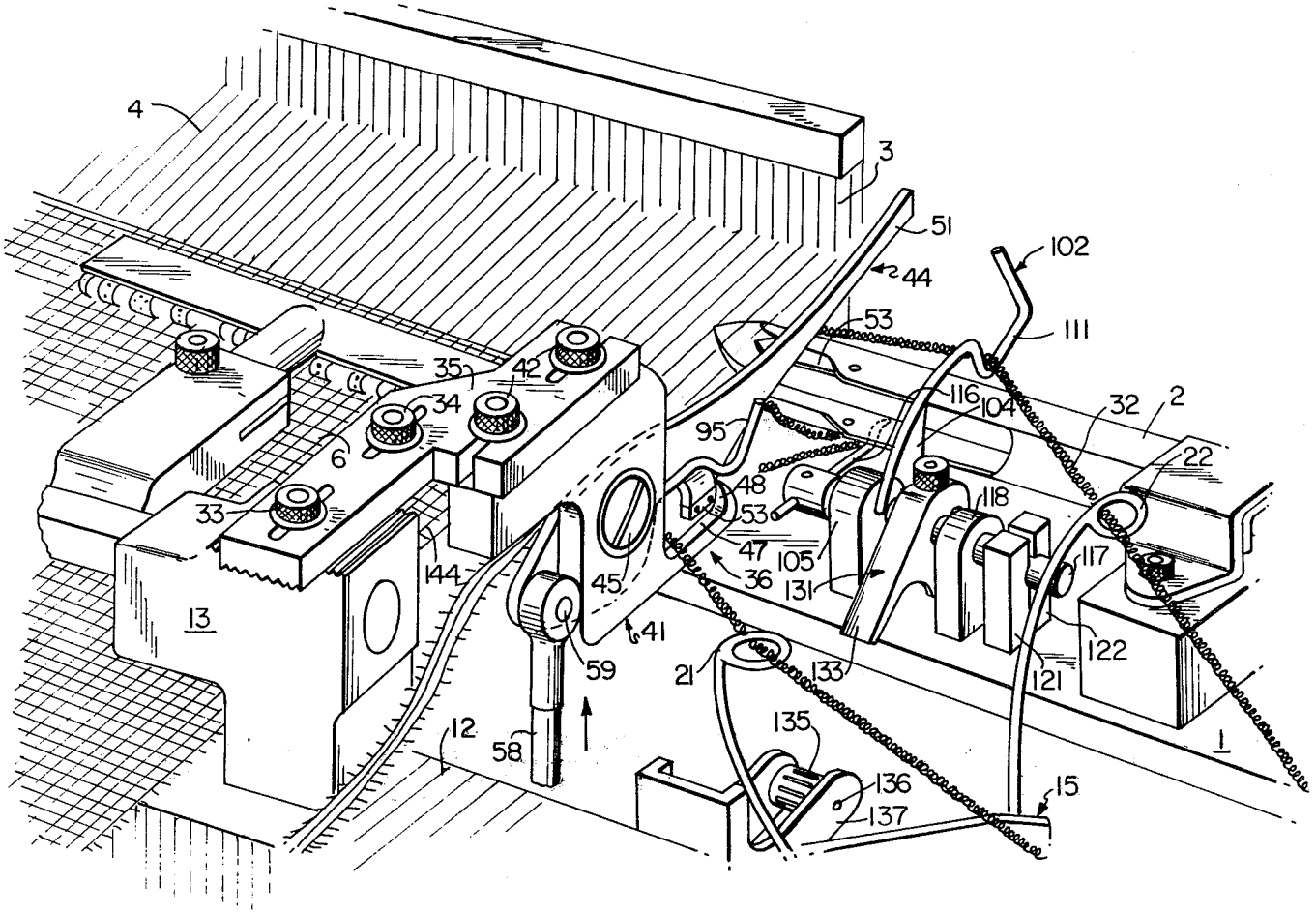

On the breast beam 12 (FIG. 9) integral with the loom framing, are secured the temple carrier 13, and a weft selecting device denoted as a whole by 15, these components being of any suitable standard kind. The weft selecting device 15 includes a plurality of presenting fingers two of which, denoted 21 and 22, are shown in FIGS. 1 and 9.

Figure 5:
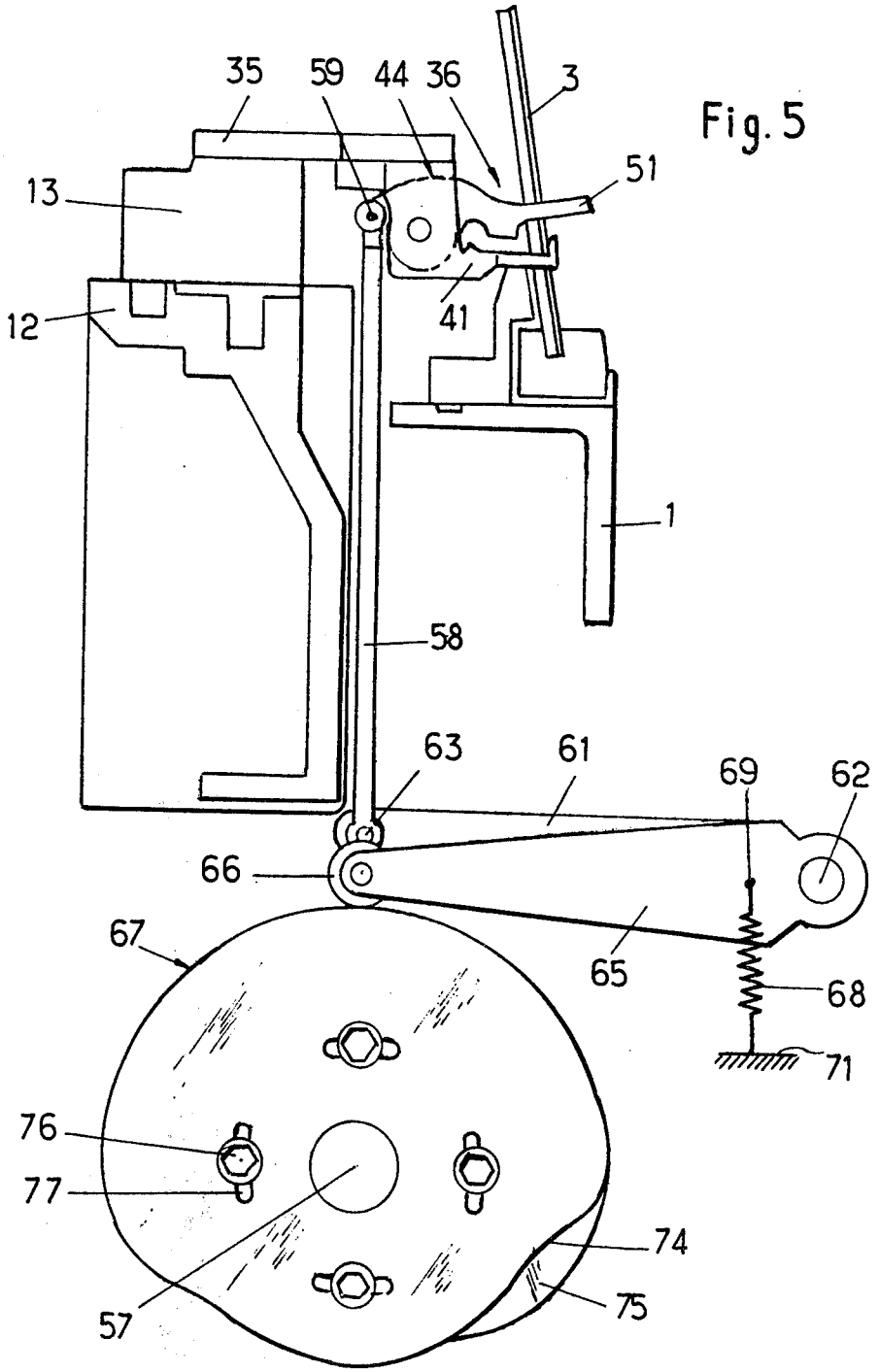
FIG. 5 is an elevational view showing the control of the cutting device on a smaller scale.

On the temple carrier 13 there is secured by means of two screws 33, 34, a bracket 35 (see also FIG. 5), which carries a weft-thread cutting device denoted as a whole by the reference 36.

Figure 3:
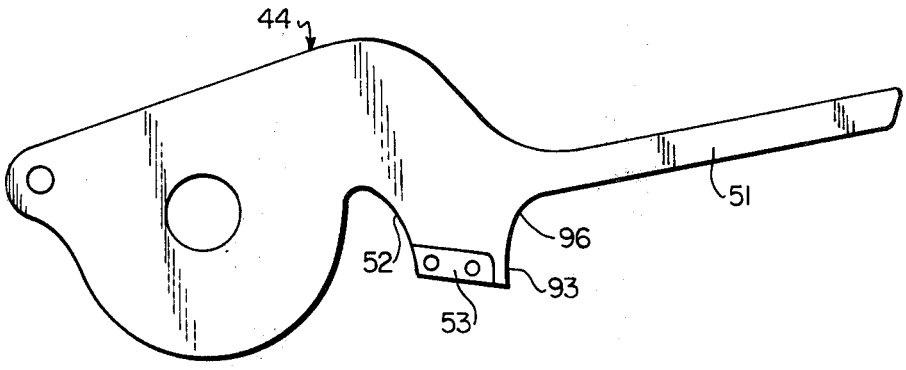
FIG. 3 is an elevational view showing the movable component alone of the cutting device of FIG. 2.
Figure 4:
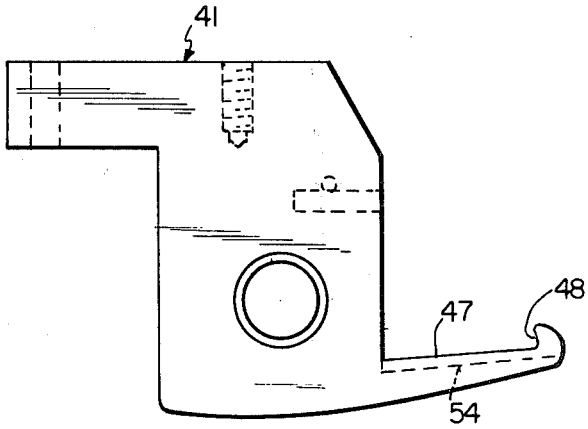
FIG. 4 is an elevational view showing the fixed component alone of the same cutting device.

The thread cutting device 36 (see also FIGS. 2, 3 and 4) is made up essentially by two components, namely: a component 41 fixed to the bracket 35 by screws such as 42 (FIG. 1) and a movable knife 44 mounted for pivotal movement on the component 41 by means of a spindle 45. The component 41 has a flange 47 ended by a forwardly-turned hook 48.

The knife includes a lever 51 and a slot 52, as well as a cutting blade 53 which co-operates with a counter-blade 54 fixed to the component 41.

The pivotal movement of the knife 44 on the component 41 is effected, from a shaft 57 (FIG. 5) which turns in synchronism with the crankshaft (not shown) for operating the sley 1, through the intermediary of a transmission which comprises: a vertical rod 58 the upper end of which is hinged through a pin 59, on the movable knife 44, an arm 61 carried by a shaft 62 and on which the other end of the rod 58 is hinged by means of a pin 63, a feeler 65 also carried by the shaft 62 and provided with a roller 66 kept in contact against a cam 67 by a spring 68 whereof one end is attached, at 69, to the feeler 65, and the other end is attached, at 71, at a loom framing position. The cam 67 is formed by two superimposed shaped disks 74, 75 which can be angularly displaced one relative to the other and made fast with one another by screws 76 mounted in the disk 75 and passing through arcuate slots 77 made in the disk 74, this enabling precise adjustment of the movement of the movable knife 44.

Figure 2:
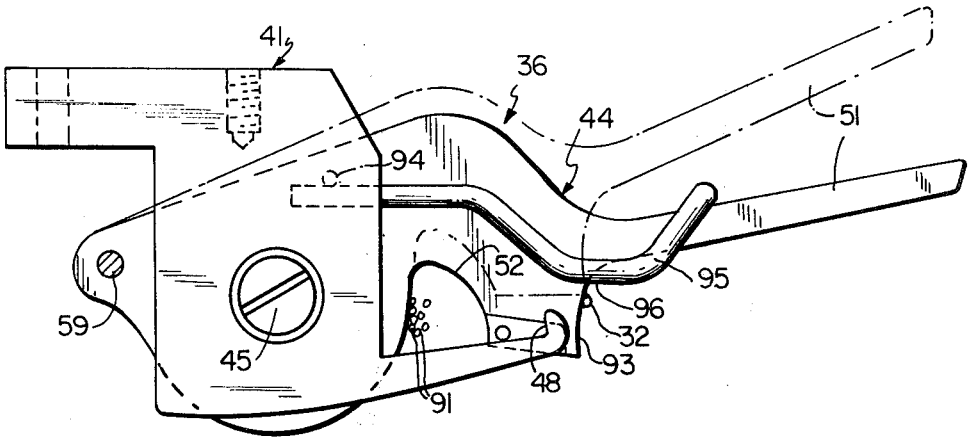
FIG. 2 is, on a larger scale, an elevational view of the weft thread cutting device shown by itself.

When the cutting device 36 is closed, the slot 52 of the movable knife 44 remains free and channels the weft threads not selected for the next insertion, such as 91 (FIG. 2). The rear part 93 of the movable knife 44, which is near the cutter blade 53 and the lever 51, is linked up with this lever by a rounded part and forms a hollow 96 for guiding the selected weft thread 32. There is secured on the component 41 of the cutting device by means of a screw 94, a guide rod 95 which has the form shown in FIG. 2. This guide rod avoids the weft thread, in the course of insertion into the shed, running the risk of deteriorating by rubbing against the cutter blade 53 of the raised movable knife, when the entry needle starts its movement; moreover, given that it is stationary, it prevents the weft thread from rising with the lever 51 when the latter goes up again. The portion of the selected weft thread 52 which must be gripped by the nippers 101 (FIG. 1) of the entry needle 2 carried by the sley is kept well in place in the path of these nippers by a threader 102 located above the path and by a lowering hook 103 timely located below said path.

Figure 6:
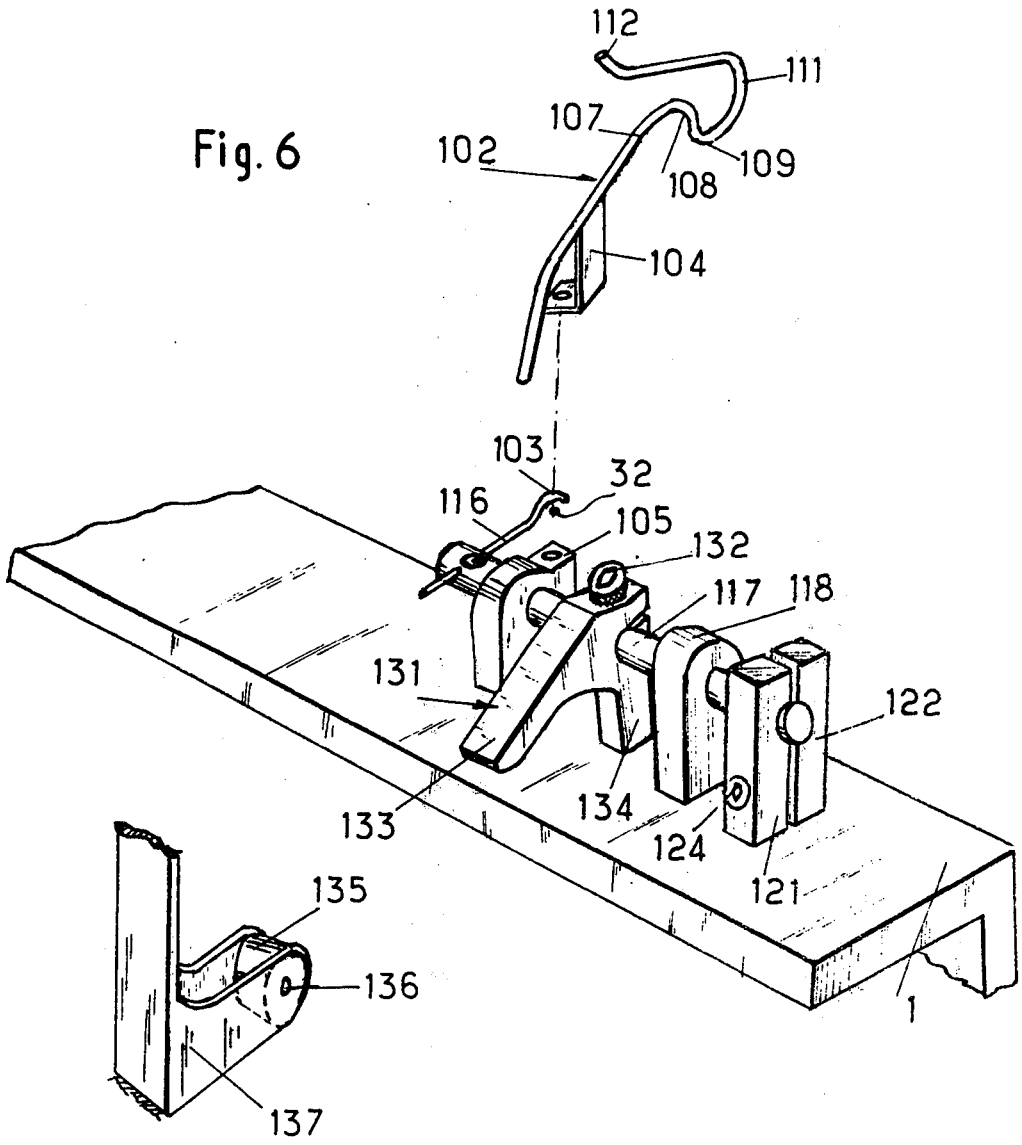
FIG. 6 is a perspective view of the mechanism for driving the weft lowering hook.

The threader 102 is constituted by a suitably shaped cylindrical rod secured to an angle-plate 104 (see also FIG. 6) fixed on the top of a block 105 itself fixed on the top of the sley 1. This rod comprises a part 107 in the form of a ramp which ascends gently towards the rear, a part 108 arched laterally in the outwards direction, a descending part 109, followed by a loop 111 which goes up again and is terminated towards the front by an upturned hook 112, so that this loop is open forwardly and upwardly.

The lowering hook 103 is formed by the extremity of a rod 116 secured on one end by a horizontal shaft 117 which is journalled in two bearings carried by the sley 1, namely: a first bearing formed by the block 105 which has already been referred to hereinbefore and a second bearing block 118. The shaft 117 is equipped with a permanent friction brake constituted by a set of two nylon blocks 121, 122 also secured on the sley 1 and squeezing between them, the other end of the shaft 117 under the influence of a screw 124.

The pivotal movements of the lowering hook 103 are ensured from the movement of the sley 1, in the vicinity of its forward dead point, through the motion of a two-armed rocking lever 131 with dead travel secured on the shaft 117 by means of a screw 132; the two arms 133, 134 of the rocking lever 131 can encompass with plenty of clearance a roller 135 loosely mounted on a horizontal spindle 136 supported by a yoke 137 rigidly secured to the breast beam 12. The greater number of the members of the lowering hock assembly and its control can also be seen in FIGS. 1 and 9, for example.

The operation of the whole is as follows:

The cycle begins when all of the components occupy the positions shown in FIG. 1, when the sley 1 is in its front neutral position, at the instant the weft thread is beat up against the feel of the cloth 6. The weft thread 32 actually selected is still connected to the selvedge 144 of the cloth 6 and it passes to the loop 111 of the threader 102 as well as into the selection finger 22 and into the brakes (not shown), this thread coming from a spool (not shown which is at the right hand side of the loom. The lowering hook 103 assumes its uppermost position.

Figure 7:
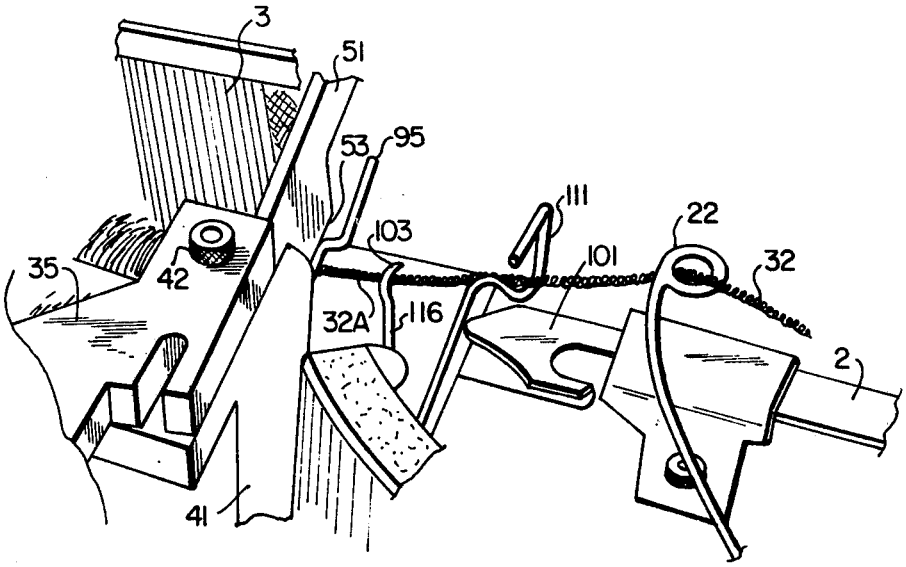
FIGS. 7 to 11, in combination with FIG. 1, illustrate the various working stages of the means according to the invention for controlling and cutting the weft threads.

The sley 1 starts to move back as shown on FIG. 7. The roller 135 (FIG. 6), which is positionally fixed, causes the arm 133 of the rocking lever 131 to rise at the start of back movement of the sley, thus ensuring pivoting of the rod 116 downwardly and, consequently, a movement of the lowering hook 103 which causes the weft thread 32 to move downwards below the path of the nippers 101 (FIG. 7) of the entry needle 2. A portion of the weft thread is thus maintained appreciably inclined in the vertical median plane of the needle, between the loop 111 of the threader 102 and the lowering hook 103 now in the low position. This portion of the thread is thus exactly on the path of the nippers of the entry needle. Simultaneously, the lowering hook 103 applies one point of this portion of weft thread on the table 47 (FIG. 4) of the thread cutter component 41. Progressively as the sley moves back, this said portion slides rearwardly on the table 47 until it is held by the hook 48 of the thread cutter component. The movable knife 44, which had previously been raised to its highest position is now taken back to an intermediate position so that its blade 53 is not higher than the hook 48, in order to avoid any danger of the weft thread escaping on passing above this hook before having to be cut.

The lowering hook 103 is at a certain distance towards the exterior in relation to the cutting blade 53 and, moreover, given that this hook and the threader 102 are moving rearwardly, with the sley which carries them and that the weft thread, not yet cut, is still connected to the selvedge 144, a certain length of thread is delivered and forms, between the position of the cutting blade 53 and the path of the needle 2, a reserve of thread 32A (FIG. 7).

Figure 8:
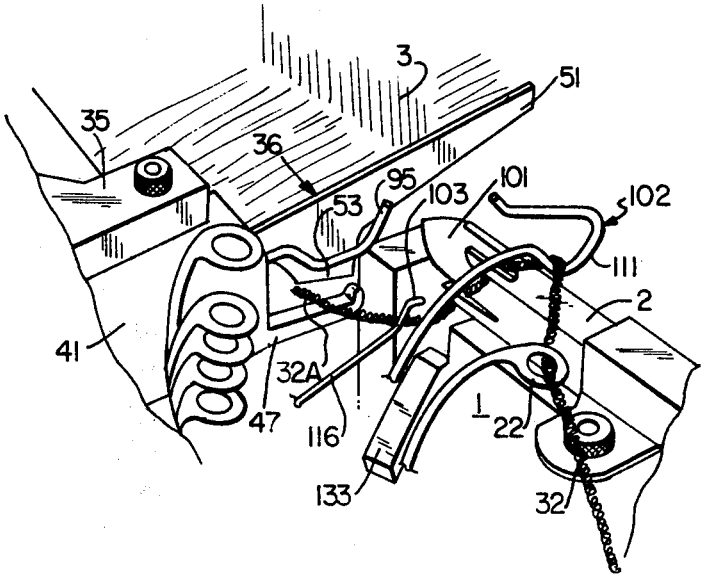

In FIG. 8 there is seen the selected weft thread 32 which is gripped by the nippers 101 of the entry needle 2, the movable knife 36 then moves downwards and cuts the weft thread quite close to the selvedge 144 (FIG. 9). The weft thread waste is very short in length as the knife is practically against the selvedge of the cloth. On the other hand, the thread reserve made up between the knife and the path of the nippers, gives rise to a dead end of the thread gripped by the needle which is relatively long, this being the objective sought after just as has been disclosed hereinbefore in the introduction.

Figure 10:
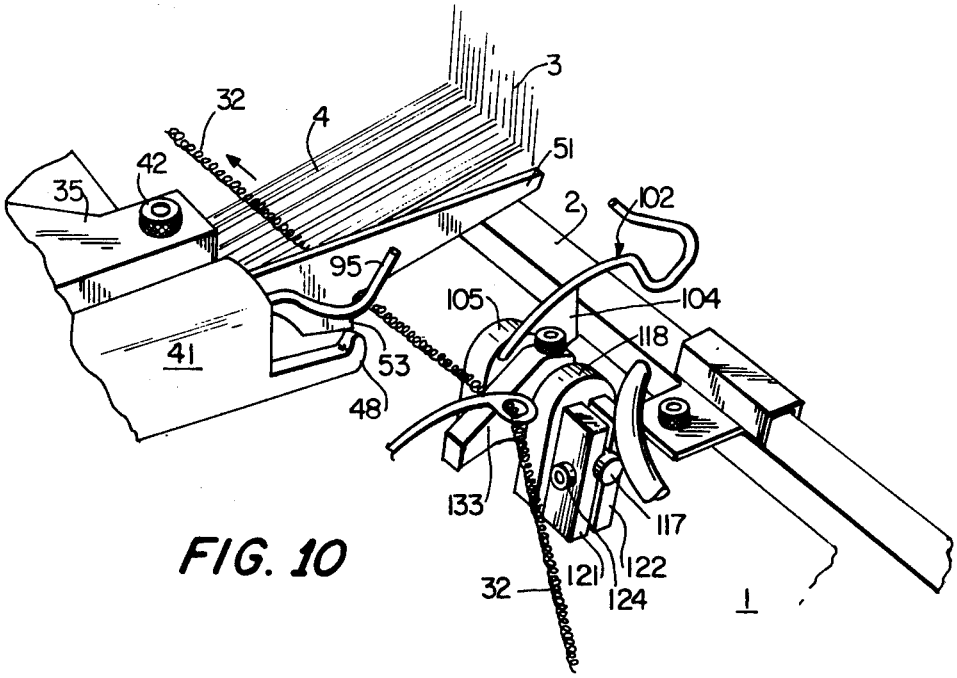

In FIG. 10, during continuance of the backwards movement of the sley and also during a part of its return in the forward direction, the selected weft thread 32 spins out against the hollow 96 (FIG. 2) connecting the rear face 93 and the lever 51 of the movable knife formed in such a manner that in the closed position of the knife, the weft thread 32 is guided substantially in the plane bisecting the dihedral angle formed by the two sheets of the shed, without rubbing, consequently, against the warp threads. This condition is maintained during the full duration of the insertion of the weft thread into the shed.

Figure 11:
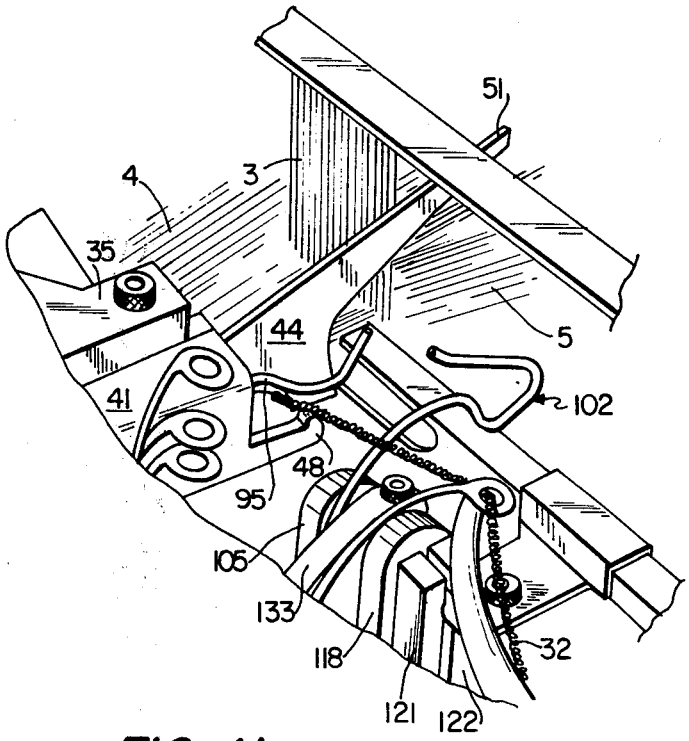

FIG. 11 shows the end of the weft insertion; the sley approaches its front neutral position, the movable knife 44 is raised to allow the weft thread to get into the hollow 52 (FIG. 2) of the movable knife, if, for the next insertion cycle, this thread is not selected again. If it were maintained in its selection position, it would simply return on to the flange 47 (FIG. 4) of the cutting device component. When the sley 1 reaches its front neutral position (FIG. 1), the arm 134 (FIG. 6) of the rocking lever 131 strikes against the roller 135, which brings about the rising of the lowering hook 103 and allows same to pass again above the selected weft thread 32 in order to be able to press it down again from the beginning of the next insertion.

Adjustment may be made of the length of the dead end which is at the front of each weft thread, by seeing, on the one hand, to the adjustment of the cam 67 (FIG. 5) controlling the knife 44, and, on the other hand, to the adjustment of the moment when the nippers 101 of the entry needle 2 are being closed.

Of course, the invention is not limited to the embodiment described and shown, and is capable of many modifications, open to the man of the art, in accordance with the applications contemplated and without thereby departing from the spirit of the invention.

I claim:

1. In a loom for weaving cloth and including a loom framework, a sley, and entry and exit weft-insertion needles each provided with nippers, the combination of means for controlling and means for cutting weft threads, comprising:

(A) a thread cutter including a component carried by the loom framework in position to be immediately proximate a selvedge of a cloth being woven, a stationary counterblade secured to said component, a movable knife, and a blade secured to said movable knife;

(B) a threading mechanism adapted to receive weft thread to be inserted and being formed by a longitudinal ramp ending at the rear thereof in an upwardly and forwardly opening loop located just above the path of the entry needle;

(C) means rigidly securing said threading mechanism on the sley;

(D) a vertically movable lowering hook carried by the sley;

(E) and means operable to move said lowering hook to a selected one of first and second positions in the first of which it is above the weft thread portion connecting said threading mechanism loop to the cloth when the sley reaches its front neutral position and in the second of which it presses a portion of the weft thread down on to the path of the entry needle nippers when the sley has already moved back a small amount;

(F) said second position of said lowering hook being located below the path of said entry needle nippers so that the portion of weft thread presented to said nippers is that located between said threading mechanism and said lowering hook.

2. In a loom for weaving cloth and including a loom framework, a sley, and entry and exit weft-insertion needles each provided with nippers, the combination of means for controlling and means for cutting weft threads, comprising:

(A) a thread cutter including a component carried by the loom framework in position to be immediately proximate a selvedge of a cloth being woven, a stationary counterblade secured to said component, a movable knife, and a blade secured to said movable knife;

(B) a threading mechanism adapted to receive weft thread to be inserted and being formed by a longitudinal ramp ending at the rear thereof in an upwardly and forwardly opening loop located just above the path of the entry needle;

(C) means rigidly securing said threading mechanism on the sley;

(D) a vertically movable lowering hook carried by the sley;

(E) means operable to move said lowering hook to a selected one of first and second positions in the first of which it is above the weft thread portion connecting said threading mechanism loop to the cloth when the sley reaches its front neutral position and in the second of which it presses a portion of the weft thread down on to the path of the entry needle nippers when the sley has already moved back a small amount;

(F) said second position of said lowering hook being located below the path of said entry needle nippers so that the portion of weft thread presented to said nippers is that located between said threading mechanism and said lowering hook;

(G) mounting said lowering hook on said sley for movement about the axis of a horizontal shaft;

(H) means controlling movement of said lowering hook from end to said first position to and from said second position, said controlling means comprising a roller carried by the loom framework, a lever with two arms passing with play about said roller in order to form a dead stroke connection, said lever being secured on said horizontal shaft; and (I) means permanently braking said shaft relative to said sley.

3. In a loom for weaving cloth and including a loom framework, a sley, and entry and exit weft-insertion needles each provided with nippers, the combination of means for controlling and means for cutting weft threads, comprising:

(A) a thread cutter including a component carried by the loom framework in position to be immediately proximate a selvedge of a cloth being woven, a stationary counterblade secured to said component, a movable knife, and a blade secured to said movable knife;

(B) a threading mechanism adapted to receive weft thread to be inserted and being formed by a longitudinal ramp ending at the rear thereof in an upwardly and forwardly opening loop located just above the path of the entry needle;

(C) means rigidly securing said threading mechanism on the sley;

(D) a vertically movable lowering hook carried by the sley;

(E) means operable to move said lowering hook to a selected one of first and second positions in the first of which it is above the weft thread portion connecting said threading mechanism loop to the cloth when the sley reaches its front neutral position and in the second of which it presses a portion of the weft thread down on to the path of the entry needle nippers when the sley has already moved back a small amount;

(F) said second position of said lowering hook being located below the path of said entry needle nippers so that the portion of weft thread presented to said nippers is that located between said threading mechanism and said lowering hook; and (G) a weft thread guiding extension at the rear end of said movable knife of said thread cutter and substantially in the plane bisecting the dihedral angle formed by the shed.

4. In a loom for weaving cloth and including a loom framework, a sley, and entry and exit weft-insertion needles each provided with nippers, the combination of means for controlling and means for cutting weft threads, comprising:

(A) a thread cutter including a component carried by the loom framework in position to be immediately proximate a selvedge of a cloth being woven, a stationary counterblade secured to said component, a movable knife, and a blade secured to said movable knife;

(B) a threading mechanism adapted to receive weft thread to be inserted and being formed by a longitudinal ramp ending at the rear thereof in an upwardly and forwardly opening loop located just above the path of the entry needle;

(C) means rigidly securing said threading mechanism on the sley;

(D) a vertically movable lowering hook carried by the sley;

(E) means operable to move said lowering hook to a selected one of first and second positions in the first of which it is above the weft thread portion connecting said threading mechanism loop to the cloth when the sley reaches its front neutral position and in the second of which it presses a portion of the weft thread down on to the path of the entry needle nippers when the sley has already moved back a small amount;

(F) said second position of said lowering hook being located below the path of said entry needle nippers so that the portion of weft thread presented to said nippers is that located between said threading mechanism and said lowering hook;

(G) a weft mixer; and (H) said component and said movable knife of said thread cutter present, immediately in front of said blades, a hollow for receiving weft threads away from the selection position.

* * * * *